US007015178B2

(12) United States Patent
Koga et al.

(10) Patent No.: US 7,015,178 B2
(45) Date of Patent: Mar. 21, 2006

(54) LUBE BASE OIL COMPOSITION

(75) Inventors: Hidetoshi Koga, Chiba (JP); Hitoshi Hata, Chiba (JP); Toshiyuki Tsubouchi, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 198 days.

(21) Appl. No.: 10/362,735

(22) PCT Filed: May 24, 2002

(86) PCT No.: PCT/JP02/05084

§ 371 (c)(1),
(2), (4) Date: Feb. 27, 2003

(87) PCT Pub. No.: WO02/097016

PCT Pub. Date: Dec. 5, 2002

(65) Prior Publication Data

US 2004/0014617 A1 Jan. 22, 2004

(30) Foreign Application Priority Data

May 29, 2001 (JP) ..... 2001-159941
Jun. 6, 2001 (JP) ..... 2001-171374

(51) Int. Cl.
*C10M 105/02* (2006.01)

(52) U.S. Cl. ..... 508/463; 508/485; 208/18; 208/19; 585/20; 585/21

(58) Field of Classification Search ..... 508/463, 508/485
See application file for complete search history.

(56) References Cited

U.S. PATENT DOCUMENTS 3,793,203 A * 2/1974 Driscoll et al. ..... 508/463
3,972,243 A * 8/1976 Driscoll et al. ..... 476/7
4,978,468 A * 12/1990 Yoshimura et al. ..... 252/79
5,039,440 A * 8/1991 Yoshimura et al. ..... 252/79
5,043,497 A * 8/1991 Muraki et al. ..... 585/20
5,344,582 A * 9/1994 Umemoto et al. ..... 508/110
6,187,979 B1 * 2/2001 Ido et al. ..... 585/10
6,191,330 B1 * 2/2001 Matsuno et al. ..... 585/21
6,242,393 B1 * 6/2001 Ishida et al. ..... 508/462
6,638,417 B1 * 10/2003 Ishida et al. ..... 208/19
6,730,640 B1 * 5/2004 Sowerby et al. ..... 508/371
6,797,680 B1 * 9/2004 Chapaton et al. ..... 508/496

FOREIGN PATENT DOCUMENTS

| | | |
|---|---|---|
| EP | 208541 | 1/1987 |
| EP | 1002855 | 5/2000 |
| GB | 2224287 | 5/1990 |
| JP | 9-279173 | 10/1997 |

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

Disclosed is a lubricant base oil composition that comprises (a) from 80 to 98% by mass of a naphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure, or comprises (a) from 85 to 99% by mass of a naphthenic synthetic lubricant base oil having a flash point of not lower than 140° C. and (c) from 1 to 15% by mass of a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%.

The lubricant base oil composition has a flash point of not lower than 150° C. and has a high traction coefficient at high temperatures, and its low-temperature flowability characteristic is good. The oil composition is favorable for traction drive fluid.

11 Claims, No Drawings

LUBE BASE OIL COMPOSITION

TECHNICAL FIELD

The present invention relates to a lubricant base oil composition, more precisely to a lubricant base oil composition suitable for traction drive fluid compositions and having good high-temperature traction characteristics and having improved low-temperature flowability characteristics.

BACKGROUND ART

Traction drive fluid for traction-type continuous variable transmissions (CVT) of automobiles must satisfy contradictory requirements that their traction coefficient is high even at high temperatures but their viscosity is low at low temperatures. Synthetic naphthenic compounds having a high traction coefficient at high temperatures are often problematic in that their flowability at low temperatures is poor. To solve this problem with them, some additive maybe added to them, which, however, will cause another problem in that the traction coefficient of the resulting mixtures may lower at higher temperatures. For example, Japanese Patent Laid-Open No. 2000-204386 discloses a traction drive fluid composition prepared by adding a poly-α-olefin to a naphthenic synthetic lubricant base oil. However, this is still problematic in that the additive, if added too much to the base oil, lowers the high-temperature traction coefficient of the resulting base oil over its additivity. On the other hand, it is generally desirable that the flash point of lube oil for automobiles is not lower than 150° C. in practical use.

The present invention has been made from the viewpoint mentioned above, and its object is to provide a lubricant base oil composition of which the flash point is not lower than 150° C. and which has good high-temperature traction characteristics and has improved low-temperature flowability characteristics.

DISCLOSURE OF THE INVENTION

We, the present inventors have assiduously studied, and, as a result, have found that, when a small amount of a specific ester compound is added to a naphthenic synthetic lubricant base oil or when a small amount of a specific mineral oil is added thereto, then the object of the invention mentioned above can be effectively attained. On the basis of these findings, we have completed the present invention.

Specifically, the invention is summarized as follows:

1. A lubricant base oil composition comprising (a) from 80 to 98% by mass of a naphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure.

2. The lubricant base oil composition of above 1, which has a flash point of not lower than 150° C.

3. The lubricant base oil composition of above 1, wherein the naphthenic synthetic lubricant base oil is a compound having a ring selected from cyclohexane, bicycloheptane and bicyclooctane rings.

4. The lubricant base oil composition of above 1, wherein the naphthenic synthetic lubricant base oil is a compound having at least two rings selected from cyclohexane, bicyclo[2.2.1]heptane, bicyclo[3.2.1]octane, bicyclo[2.2.2]octane and bicyclo[3.3.0]octane rings.

5. The lubricant base oil composition of above 1, wherein the alcohol is 3,3,5-trimethylhexanol, 3,5,5,7,7-pentamethyloctanol or neopentyl glycol.

6. The lubricant base oil composition of above 1, wherein the fatty acid has a gem-type dimethyl structure.

7. The lubricant base oil composition of above 1, wherein the fatty acid is 3,5,5-trimethylhexanoic acid.

8. The lubricant base oil composition of above 1, wherein the fatty acid ester with an alcohol having a gem-type dimethyl structure has from 18 to 23 carbon atoms in total.

9. A traction drive fluid comprising (a) from 80 to 98% by mass of a naphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure.

10. An automobile transmission method of using a lubricant base oil composition that comprises (a) from 80 to 98% by mass of a naphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure, for traction-type continuous variable transmissions of automobiles.

11. A method of using a lubricant base oil composition that comprises (a) from 80 to 98% by mass of anaphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure, for traction drive fluid.

12. A lubricant base oil composition comprising (a) from 85 to 99% by mass of a naphthenic synthetic lubricant base oil having a flash point of not lower than 140° C. and (c) from 1 to 15% by mass of a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%.

13. The lubricant base oil composition of above 12, which has a flash point of not lower than 150° C.

14. The lubricant base oil composition of claim 12, wherein the naphthenic synthetic lubricant base oil is a compound having a ring selected from cyclohexane, bicycloheptane and bicyclooctane rings.

15. The lubricant base oil composition of above 12, wherein the naphthenic synthetic lubricant base oil is a compound having at least two rings selected from cyclohexane, bicyclo[2.2.1]heptane, bicyclo[3.2.1]octane, bicyclo[2.2.2]octane and bicyclo[3.3.0]octane rings.

16. The lubricant base oil composition of above 12, wherein the mineral oil for the component (c) has a kinematic viscosity at 40° C. of from 0.9 to 3.2 $mm^2$/sec, a boiling point under normal pressure of from 150 to 300° C. and a % CA measured through ring analysis (in n-d-M process) of at most 5%.

17. A traction drive fluid comprising (a) from 85 to 99% by mass of a naphthenic synthetic lubricant base oil having a flash point of not lower than 140° C. and (c) from 1 to 15% by mass of a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%.

18. An automobile transmission method of using a lubricant base oil composition that comprises (a) from 85 to 99% by mass of a naphthenic synthetic lubricant base oil having a flash point of not lower than 140° C. and (c) from 1 to 15% by mass of a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%, for traction-type continuous variable transmissions of automobiles.

19. A method of using a lubricant base oil composition that comprises (a) from 85 to 99% by mass of a naphthenic synthetic lubricant base oil having a flash point of not lower than 140° C. and (c) from 1 to 15% by mass of a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%, for traction drive fluid.

BEST MODES OF CARRYING OUT THE INVENTION

The invention is described in detail hereinunder.

The component (a) in the invention is a naphthenic synthetic lubricant base oil having a flash point of not lower than 140° C. A different naphthenic synthetic lubricant base oil of which the flash point is lower than 140° C. is unfavorable since its mixture with an ester compound added thereto could not have a flash point of not lower than 150° C. In addition, the oil of the type having a flash point of lower than 140° C. is also unfavorable since its mixture with a mineral oil of the component (c) added thereto could not have a flash point of not lower than 150° C. Preferably, the naphthenic synthetic lubricant base oil is a compound having a ring selected from cyclohexane, bicycloheptane and bicyclooctane rings. More preferably, it is a compound having at least two rings selected from cyclohexane, bicyclo[2.2.1]heptane, bicyclo[3.2.1]octane, bicyclo[2.2.2]octane and bicyclo[3.3.0]octane rings.

Concretely, the oil is preferably selected from dimer hydrides of at least one alicyclic compound selected from bicyclo[2.2.1]heptane ring compounds, bicyclo[3.2.1]octane ring compounds, bicyclo[3.3.0]octane ring compounds and bicyclo[2.2.2]octane ring compounds, and cyclohexane ring compounds such as 2,4-dicyclohexyl-2-methylpentane, 2,4-dicyclohexylpentane, 2,4-dicyclohexyl-2-methylbutane, 1-decahydronaphthyl-1-cyclohexylethane.

One preferred method of producing the alicyclic compound dimer hydrides mentioned above comprises, for example, dimerizing an optionally alkyl-substituted olefin such as that mentioned below, hydrogenating the resulting dimer and taking it out through distillation.

The starting compound, olefin optionally substituted with an alkyl group such as a methyl, ethyl or propyl group includes, for example, bicyclo[2.2.1]hept-2-ene; alkenyl-substituted bicyclo[2.2.1]hept-2-enes such as vinyl-substituted or isopropenyl-substituted bicyclo[2.2.1]hept-2-ene; alkylidene-substituted bicyclo[2.2.1]hept-2-enes such as methylene-substituted, ethylidene-substituted or isopropylidene-substituted bicyclo[2.2.1]hept-2-ene; alkenyl-substituted bicyclo[2.2.1]heptanes such as vinyl-substituted or isopropenyl-substituted bicyclo[2.2.1]heptane; alkylidene-substituted bicyclo[2.2.1]heptanes such as methylene-substituted, ethylidene-substituted or isopropylidene-substituted bicyclo[2.2.1]heptane; bicyclo[3.2.1]octene; alkenyl-substituted bicyclo[3.2.1]octenes such as vinyl-substituted or isopropenyl-substituted bicyclo[3.2.1]octene; alkylidene-substituted bicyclo[3.2.1]octenes such as methylene-substituted, ethylidene-substituted or isopropylidene-substituted bicyclo[3.2.1]octene; alkenyl-substituted bicyclo[3.2.1]octanes such as vinyl-substituted or isopropenyl-substituted bicyclo[3.2.1]octane; alkylidene-substituted bicyclo[3.2.1]octane; alkylidene-substituted bicyclo[3.2.1]octanes such as methylene-substituted, ethylidene-substituted or isopropylidene-substituted bicyclo[3.2.1]octane; bicyclo[3.3.0]octene; alkenyl-substituted bicyclo[3.3.0]octenes such as vinyl-substituted or isopropenyl-substituted bicyclo[3.3.0]octene; alkylidene-substituted bicyclo[3.3.0]octenes such as methylene-substituted, ethylidene-substituted or isopropylidene-substituted bicyclo[3.3.0]octene; alkenyl-substituted bicyclo[3.3.0]octanes such as vinyl-substituted or isopropenyl-substituted bicyclo[3.3.0]octane; alkylidene-substituted bicyclo[3.3.0]octanes such as methylene-substituted, ethylidene-substituted or isopropylidene-substituted bicyclo[3.3.0]octane; bicyclo[2.2.2]octene; alkenyl-substituted bicyclo[2.2.2]octenes such as vinyl-substituted or isopropenyl-substituted bicyclo[2.2.2]octene; alkylidene-substituted bicyclo[2.2.2]octenes such as methylene-substituted, ethylidene-substituted or isopropylidene-substituted bicyclo[2.2.2]octene; alkenyl-substituted bicyclo[2.2.2]octanes such as vinyl-substituted or isopropenyl-substituted bicyclo[2.2.2]octane; and alkylidene-substituted bicyclo[2.2.2]octanes such as methylene-substituted, ethylidene-substituted or isopropylidene-substituted bicyclo[2.2.2]octane.

Above all, especially preferred are dimer hydrides of bicyclo[2.2.1]heptane ring compounds, for which, concretely, the starting olefin includes, for example, bicyclo[2.2.1]hept-2-ene; 2-methylenebicyclo[2.2.1]heptane; 2-methylbicyclo[2.2.1]hept-2-ene; 2-methylele-3-methylbicyclo[2.2.1]heptane; 3-methylene-2-methylbicyclo[2.2.1]heptane; 2,3-dimethylbicyclo[2.2.1]hept-2-ene; 2-methylene-7-methylbicyclo[2.2.1]heptane; 3-methylene-7-methylbicyclo[2.2.1]heptane; 2,7-dimethylbicyclo[2.2.1]hept-2-ene; 2-methylene-5-methylbicyclo[2.2.1]heptane; 3-methylene-5-methylbicyclo[2.2.1]heptane; 2,5-dimethylbicyclo[2.2.1]hept-2-ene; 2-methylene-6-methylbicyclo[2.2.1]heptane; 3-methylene-6-methylbicyclo[2.2.1]heptane; 2,6-dimethylbicyclo[2.2.1]hept-2-ene; 2-methylene-1-methylbicyclo[2.2.1]heptane; 3-methylene-1-methylbicyclo[2.2.1]heptane; 1,2-dimethylbicyclo[2.2.1]hept-2-ene; 2-methylene-4-methylbicyclo[2.2.1]heptane; 3-methylene-4-methylbicyclo[2.2.1]heptane; 2,4-dimethylbicyclo[2.2.1]hept-2-ene; 2-methylene-3,7-dimethylbicyclo[2.2.1]heptane; 3-methylene-2,7-dimethylbicyclo[2.2.1]heptane; 2,3,7-trimethylbicyclo[2.2.1]hept-2-ene; 2-methylene-3,6-dimethylbicyclo[2.2.1]heptane; 3-methylene-2,6-dimethylbicyclo[2.2.1]heptane; 2-methylene-3,3-dimethylbicyclo[2.2.1]heptane; 3-methylene-2,2-dimethylbicyclo[2.2.1]heptane; 2,3,6-trimethylbicyclo[2.2.1]hept-2-ene; 2-methylene-3-ethylbicyclo[2.2.1]heptane; 3-methylene-2-ethylbicyclo[2.2.1]heptane; 2-methyl-3-ethylbicyclo[2.2.1]hept-2-ene.

Dimerization referred to herein is meant to include not only dimerization of an olefin of the same type but also co-dimerization of multiple olefins of different types.

The olefin dimerization may be effected generally in the presence of a catalyst and optionally in an solvent added thereto.

The catalyst for the dimerization is generally an acid catalyst. Concretely, it includes solid acids such as activated clay, zeolite, montmorillonite, ion-exchange resin; mineral acids such as hydrofluoric acid, polyphosphoric acid; organic acids such as Triflic acid; Lewis acids such as aluminium chloride, ferric chloride, stannic chloride, boron trifluoride, boron trifluoride complex, boron tribromide, aluminium bromide, gallium chloride, gallium bromide; and organoaluminium compounds such as triethylaluminium, diethylaluminium chloride, ethylaluminium dichloride.

Though not specifically defined, the amount of the catalyst to be used for olefin dimerization may fall generally between 0.1 and 100 parts by weight relative to the starting olefin.

The dimerization does not always require a solvent but may be effected in a solvent for ready handling of the starting olefin and the catalyst used for the reaction and for controlling the reaction. The solvent includes, for example, saturated hydrocarbons such as various types of pentanes, various types of hexanes, various types of octanes, various types of nonanes and various types of decanes; alicyclic hydrocarbons such as cyclopentane, cyclohexane, methylcyclohexane, decalin; ether compounds such as diethyl ether, tetrahydrofuran; halogen-containing compounds such as methylene chloride, dichloroethane; and nitro compounds such as nitromethane, nitrobenzene.

The starting olefin is dimerized in the presence of the catalyst as above, and the reaction temperature generally falls between −70 and 200° C. Within the temperature range, the suitable condition for the reaction is determined depending on the type of the catalyst used and the additives to the reaction system. In general, the reaction pressure may be normal pressure; and the reaction time may fall between 0.5 and 10 hours.

Next, the thus-obtained olefin dimer is hydrogenated into the intended dimer hydride. If desired, olefin dimers that have been separately prepared by dimerizing different olefins may be combined appropriately and the resulting dimer mixture may be hydrogenated at a time.

The hydrogenation is effected generally in the presence of a catalyst. The catalyst is for hydrogenation, including, for example, nickel, ruthenium, palladium, platinum, rhodium, iridium. The amount of the catalyst to be used generally falls between 0.1 and 100 parts by weight relative to the olefin dimer to be hydrogenated with it.

Like the dimerization mentioned above, the hydrogenation may also be effected in the absence of a solvent, but may be effected in a solvent. The solvent includes, for example, saturated hydrocarbons such as various types of pentanes, various types of hexanes, various types of octanes, various types of nonanes, various types of decanes; and alicyclic hydrocarbons such as cyclopentane, cyclohexane, methylcyclohexane, decalin.

The reaction temperature generally falls between 20 and 300° C.; and the reaction pressure generally falls between normal pressure and 20 MPa·G. The reaction time generally falls between 1 and 10 hours. The thus-produced hydride may be mixed with any other hydride that has been produced from a different starting olefin in a different process, and the resulting mixture may serve as the base oil of the component (a).

The component (b) to constitute the oil composition of the invention is an alcohol/fatty acid ester having a flash point of not lower than 150° C. of which the alcohol has a gem-type dimethyl structure. A different ester of which the flash point is lower than 150° C. is unfavorable since the flash point of the mixed oil containing it will be lower than 150° C. The alcohol to form the ester of the component (b) has a gem-type dimethyl structure, and is preferably a monoalcohol such as 3,3,5-trimethylhexanol or 3,5,5,7,7-pentamethyloctanol; or a diol such as neopentyl glycol or hexylene glycol. Above all, preferred for the alcohol are 3,3,5-trimethylhexanol, 3,5,5,7,7-pentamethyloctanol and neopentyl glycol.

Preferably, the fatty acid to form the ester for the component (b) also has a gem-type dimethyl structure. Concretely, it includes, for example, 3,5,5-trimethylhexanoic acid and 3,5,5,7,7-pentamethylocatanoic acid. Of those, especially preferred is 3,5,5-trimethylhexanoic acid. In case where the alcohol for the ester for the component (b) is a diol, the ester may be a monoester or a diester. Preferably, the number of all carbon atoms that constitute the ester for the component (b) is controlled to fall between 18 and 23.

The lubricant base oil composition is obtained by mixing the component (a) and the component (b). Regarding the ratio of the component (a) to the component (b), the amount of the component (a) falls between 80 and 98% by mass and that of the component (b) falls between 2 and 20% by mass of the total of the components (a) and (b).

The ratio of the component (b) is described. If its amount is smaller than 2% bymass, the component (b) will be ineffective for improving the low-temperature flowability of the oil composition; but if larger than 20% by mass, the high-temperature traction coefficient of the oil composition will lower. Preferably, the amount of the component (b) to be in the oil composition falls between 3 and 18% by mass. Accordingly, the preferred range of the component (a) in the composition falls between 82 and 97% by mass.

Next described in the component (c) to constitute the oil composition of the invention. The component (c) is a mineral oil having a kinematic viscosity at 40° C. of from 0.9 to 9.6 $mm^2$/sec, a boiling point under normal pressure of from 150 to 400° C. and a % CA measured through ring analysis (in n-d-M process) of at most 10%. A mineral oil of which the kinematic viscosity at 40° C. is lower than 0.9 $mm^2$/sec is unfavorable since the flash point of the mixed oil will be lower than 150° C.; and a mineral oil of which the kinematic viscosity at 40° C. is higher than 9.6 $mm^2$/sec is also unfavorable since the mixed oil requires an excess amount of the mineral oil in order that it may have the intended low-temperature viscosity. Preferably, the kinematic viscosity of the mineral oil for use in the invention falls between 0.9 and 3.2 $mm^2$/sec.

On the other hand, a mineral oil having a boiling point under normal pressure of lower than 150° C. is unfavorable since the flash point of the mixed oil will be lower than 150° C.; and a mineral oil having a boiling point of higher than 400° C. is also unfavorable since its kinematic viscosity at 40° C. is larger than 9.6 $mm^2$/sec. Preferably, the boiling point of the mineral oil falls between 150 and 300° C.

A mineral oil having a % CA measured through ring analysis of higher than 10% is unfavorable since the viscosity index of the mixed oil lowers and since the low-temperature viscosity of the mixed oil does not lower relative to the amount of the mineral oil added to the base oil. Preferably, the mineral oil for use herein has a % CA of at most 5%.

The mineral oil that satisfies the requirement for use in the invention may be selected from distillate oils obtained through normal pressure distillation of paraffin-base crude oil, intermediate-base crude oil or naphthene-base crude oil or through reduced pressure distillation of bottom oil in normal pressure distillation of such crude oil, or pure oils obtained through ordinary purification of these distilled oils, such as solvent-purified oil, hydrogenation-purified oil, dewaxed oil, clay-processed oil, etc.

The lubricant base oil composition of the invention that comprises the above-mentioned naphthenic synthetic lubricant base oil and a small amount of a specific mineral oil added thereto is obtained by mixing the components (a) and (c). Regarding the ratio of the component (a) to the component (c), the amount of the component (a) falls between 85 and 99% by mass and that of the component (c) falls between 1 and 15% by mass of the total of the components (a) and (c).

The ratio of the component (c) is described. If its amount is smaller than 1% by mass, the component (c) will be ineffective for improving the low-temperature flowability of the oil composition; but if larger than 15% by mass, the high-temperature traction coefficient of the oil composition will lower. Preferably, the amount of the component (c) to be in the oil composition falls between 3 and 10% by mass. Accordingly, the preferred range of the component (a) in the composition falls between 90 and 97% by mass.

If desired, the lubricant base oil composition of the invention may appropriately contain various additives of, for example, antioxidant, rust inhibitor, detergent dispersant, pour point depressant, viscosity index improver, extreme pressure agent, abrasion inhibitor, oily agent, defoaming agent and corrosion inhibitor.

The lubricant base oil composition of the invention may be used for traction drive fluid, transmission oil, hydraulic actuator oil, compressor oil, electric insulation oil, etc. Above all, it is favorable to traction drive fluid.

The invention is described more concretely with reference to the following Examples, which, however, are not intended to restrict the scope of the invention.

REFERENCE EXAMPLE 1

350.5 g (5 mols) of crotonaldehyde and 198.3 g (1.5 mols) of dicyclopentadiene were put into a one-liter stainless autoclave, and reacted with stirring there in at 170° C. for 2 hours. The reaction mixture was cooled to room temperature. 22 g of 5 wt. % ruthenium-carbon catalyst (from NE Chemcat) was added thereto, and this was hydrogenated under a hydrogen pressure of 6.86 MPa·G at a reaction temperature of 180° C. for 4 hours. After this was cooled, the catalyst was removed from it through filtration, and the resulting filtrate was distilled under reduced pressure to obtain 242 g of a fraction of 70° C./1.20 hPa. This fraction was analyzed through mass spectrometry and nuclear magnetic resonance spectrometry, and it was identified as 2-hydroxymethyl-3-methylbicyclo[2.2.1]heptane and 3-hydroxymethyl-2-methylbicyclo[2.2.1]heptane.

Next, 15 g of γ-alumina (Nikki Chemical's N612) was put into a flow-method normal pressure reactor tube of quartz glass having an outer diameter of 20 mm and a length of 500 mm, and the fraction as above was dehydrated in the reactor tube at a reaction temperature of 280° C. and at a weight-hourly space velocity (WHSV) of 1.07 $hr^{-1}$. The reaction gave 196 g of a dehydrated product of 2-hydroxymethyl-3-methylbicyclo[2.2.1]heptane and 3-hydroxymethyl-2-methylbicyclo[2.2.1]heptane that contains 65% by mass of 2-methylene-3-methylbicyclo[2.2.1]heptane and 3-methylene-2-methylbicyclo[2.2.1]heptane and 28% by mass of 2,3-dimethylbicyclo[2.2.1]hept-2-ene.

(Preparation of Dimer Hydride)

9.5g of dry activated clay (Mizusawa Industrial Chemicals' Galleon Earth NS) and 190 g of the olefin compound obtained in the above were put into a 500-ml four-neck flask, and dimerized with stirring at 145° C. for 3 hours therein. The activated clay was filtered away from the reaction mixture. 6 g of nickel/diatomaceous earth catalyst for hydrogenation (Nikki Chemical's N-113) was put into a one-liter autoclave, and the dimerized product was hydrogenated in this under a hydrogen pressure of 3.92 MPa·G and at a reaction temperature of 160° C. for 3 hours. After the reaction, the catalyst was taken out through filtration and the resulting filtrate was distilled under reduced pressure. This gave 116 g of a dimer hydride fraction of which the boiling point falls between 126 and 128° C./2.67 daPa. The general properties and the traction coefficient of the dimer hydride are shown in Table 1.

COMPARATIVE EXAMPLE 1

The base oil obtained in Reference Example 1 was mixed with a 1-decene dimer hydride (Idemitsu's PAO-5002, having a flash point of 171° C.), in which the dimer hydride accounted for 15% by mass of the resulting composition. The general properties and the traction coefficient of the composition are shown in Table 1.

EXAMPLE 1

The base oil obtained in Reference Example 1 was mixed with an ester compound (Kokyu Alcohol Kogyo's 3,5,5-trimethylhexanol ester of 3,3,5-trimethylhexanoic acid, having a flash point of 156° C.), in which the ester compound accounted for 15% by mass of the resulting composition. The general properties and the traction coefficient of the composition are shown in Table 1.

REFERENCE EXAMPLE 2

4 g of activated clay (Mizusawa Industrial Chemicals' Galleon Earth NS), 10 g of diethylene glycol monomethyl ether and 200 g of α-methylstyrene were put into a 500-ml four-neck flask equipped with a reflux condenser, a stirrer and a thermometer, and stirred for 4 hours with heating at 105° C. After the reaction, the reaction mixture was analyzed through gas chromatography, and it confirmed that the conversion is 70%, the selectivity of the intended product, α-methylstyrene linear dimer is 95%, the selectivity of the side product, α-methylstyrene cyclic dimer is 1% and the selectivity of high-boiling-point substances such as trimers and others is 4%. Like in Comparative Example 1, the reaction product was hydrogenated and distilled under reduced pressure to obtain 125 g of an α-methylstyrene linear dimer hydride having a purity of 99% by mass, or that is, 2,4-dicyclohexyl-2-methylpentane. The general properties and the traction coefficient of the dimer hydride are shown in Table 1.

EXAMPLE 2

The base oil (2,4-dicyclohexyl-2-methylpentane) obtained in Reference Example 2 was mixed with an ester compound (Kokyu Alcohol Kogyo's 3,5,5-trimethylhexanol ester of 3,3,5-trimethylhexanoic acid, having a flash point of 156° C.), in which the ester compound accounted for 10% by mass of the resulting composition. The general properties and the traction coefficient of the composition are shown in Table 1.

EXAMPLE 3

The base oil (2,4-dicyclohexyl-2-methylpentane) obtained in Reference Example 2 was mixed with an ester compound (Kokyu Alcohol Kogyo's 3,5,5-trimethylhexanol ester of 3,3,5-trimethylhexanoic acid, having a flash point of 156° C.), in which the ester compound accounted for 15% by mass of the resulting composition. The general properties and the traction coefficient of the composition are shown in Table 1.

EXAMPLE 4

The base oil obtained in Reference Example 1 was mixed with a naphthenic mineral oil (having a kinematic viscosity at 40° C. of 2.24 $mm^2$/sec, a boiling point of from 237.5 to 252.5° C., and a % CA of smaller than 3%), in which the mineral oil accounted for 5% by mass of the resulting composition. The general properties and the traction coefficient of the composition are shown in Table 2.

EXAMPLE 5

The base oil obtained in Reference Example 1 was mixed with a naphthenic mineral oil (having a kinematic viscosity at 40° C. of 2.24 $mm^2$/sec, a boiling point of from 237.5 to 252.5° C., and a % CA of smaller than 3%), in which the mineral oil accounted for 10% by mass of the resulting composition. The general properties and the traction coefficient of the composition are shown in Table 2.

COMPARATIVE EXAMPLE 2

The base oil obtained in Reference Example 1 was mixed with a 1-decene dimer hydride (Idemitsu's PAO-5002, having a flash point of 171° C.), in which the dimer hydride accounted for 5% by mass of the resulting composition. The general properties and the traction coefficient of the composition are shown in Table 2.

COMPARATIVE EXAMPLE 3

The base oil obtained in Reference Example 1 was mixed with a 1-decene dimer hydride (Idemitsu's PAO-5002, having a flash point of 171° C.), in which the dimer hydride accounted for 10% by mass of the resulting composition. The general properties and the traction coefficient of the composition are shown in Table 2.

The traction coefficient of each oil sample in the above Examples and Comparative Examples was measured with a bi-cylindrical friction tester. Concretely, two cylinders of the same size are kept in contact in the tester. Both the two have a diameter of 52 mm and a thickness of 6 mm; and one of them on the driven side is a drum type having a radius of curvature of 10 mm, and the other on the driving side is a flat type with no crowning. One of the two cylinders is run at a predetermined constant rate while the other is run at a continuously varying revolution speed, and a load of 98.0 N is imparted to the contact part of the two cylinders by applying a weight thereto. In that condition, the tangential force, or that is, the traction force having occurred between the two cylinders that run with an oil sample being applied thereto is measured, and the traction coefficient of the oil sample tested is obtained from it. The cylinders are made of bearing steel SUJ-2, and are mirror-finished; their mean peripheral speed is 6.8 m/sec; and the maximum Hertz's contact pressure between them is 1.23 GPa. In case where the traction coefficient of the oil sample is measured with its fluid temperature (oil temperature) being kept at 140° C., the oil tank is heated with a heater so as to be from 40° C. up to 140° C., and the traction coefficient of the oil sample thus heated is measured at a slip factor of 5%.

TABLE 1-1

| | Ref. Example 1 | Comp. Example 1 | Example 1 |
|---|---|---|---|
| Kinematic Viscosity (at 40° C.), $mm^2$/sec | 24.3 | 14.2 | 14.3 |
| Kinematic Viscosity (at 100° C.), $mm^2$/sec | 4.21 | 3.16 | 3.21 |
| Pour Point, ° C. | −47.5 | −50.0 | −50.0 |
| Low-temperature Viscosity (at −40° C.), mPa · s | 200,000 | 14,000 | 17,200 |
| Traction Coefficient (at 140° C.) | 0.083 | 0.051 | 0.068 |
| Flash Point, ° C. | 158 | 160 | 158 |

TABLE 1-2

| | Ref. Example 2 | Example 2 | Example 3 |
|---|---|---|---|
| Kinematic Viscosity (at 40° C.), $mm^2$/sec | 20.2 | 15.7 | 14.0 |
| Kinematic Viscosity (at 100° C.), $mm^2$/sec | 3.57 | 3.20 | 3.04 |
| Pour Point, ° C. | −42.5 | −47.5 | <−50.0 |
| Low-temperature Viscosity (at −40° C.), mPa · s | >300,000 | 71,500 | 40,000 |
| Traction Coefficient (at 140° C.) | 0.070 | 0.069 | 0.064 |
| Flash Point, ° C. | 163 | 162 | 160 |

TABLE 2-1

| | Example 4 | Example 5 |
|---|---|---|
| Kinematic Viscosity (at 40° C.), $mm^2$/sec | 17.0 | 14.15 |
| Kinematic Viscosity (at 100° C.), $mm^2$/sec | 3.46 | 3.13 |
| Pour Point, ° C. | −50.0 | −50.0 |
| Low-temperature Viscosity (at −40° C.), mPa · s | 45,300 | 19,800 |
| Traction Coefficient (at 140° C.) | 0.076 | 0.068 |
| Flash Point, ° C. | 156 | 150 |

TABLE 2-2

| | Comp. Example 2 | Comp. Example 3 |
|---|---|---|
| Kinematic Viscosity (at 40° C.), $mm^2$/sec | 18.4 | 16.1 |
| Kinematic Viscosity (at 100° C.), $mm^2$/sec | 3.62 | 3.37 |
| Pour Point, ° C. | −50.0 | −50.0> |
| Low-temperature Viscosity (at −40° C.), mPa · s | 56,000 | 26,000 |
| Traction Coefficient (at 140° C.) | 0.070 | 0.051 |
| Flash Point, ° C. | 158 | 160 |

INDUSTRIAL APPLICABILITY

The lubricant base oil composition of the invention has a flash point of not lower than 150° C. and has a high traction coefficient at high temperatures. In addition, its low-temperature flowability characteristic is good, and it is practicable for traction drive-type continuous variable transmission (CVT) oil anywhere all over the world from cold districts to hot districts.

The invention claimed is:

1. A lubricant base oil composition comprising (a) from 80 to 98% by mass of a naphthenic synthetic lubricant base oil having a flash point of not lower than 140° C. and (b) from 2 to 20% by mass of an alcohol/fatty acid ester having a flash point of not lower than 150° C. of which the alcohol has a gem-type dimethyl structure.

2. The lubricant base oil composition as claimed in claim 1, which has a flash point of not lower than 150° C.

3. The lubricant base oil composition as claimed in claim 1, wherein the naphthenic synthetic lubricant base oil is a compound having a ring selected from cyclohexane, bicycloheptane and bicyclooctane rings.

4. The lubricant base oil composition as claimed in claim 1, where in the naphthenic synthetic lubricant base oil is a compound having at least two rings selected from cyclohexane, bicycle[2.2.1]heptane, bicycle[3.2.1]octane, bicycle [2.2 .2]octane and bicycle[3.3.0]octane rings.

5. The lubricant base oil composition as claimed in claim 1, wherein the alcohol is 3,3,5-trimethylhexanol, 3,5,5,7,7-pentamethyloctanol or neopentyl glycol.

6. The lubricant base oil composition as claimed in claim 1, wherein the fatty acid has a gem-typedimethyl structure.

7. The lubricant base oil composition as claimed in claim 1, wherein the fatty acid is 3,5,5-trimethylhexanoic acid.

8. The lubricant base oil composition as claimed in claim 1, wherein the fatty acid ester with an alcohol having a gem-type dimethyl structure has from 18 to 23 carbon atoms in total.

9. A traction drive fluid comprising (a) from 80 to 98% by mass of a naphthenic synthetic lubricant base oil having a flash point of not lower than 140° and (b) from 2 to 20% by mass of an alcohol/fatty acid ester having a flash point of not lower than 150° C. of which the alcohol has a gem-type dimethyl structure.

10. An automobile transmission method of using a lubricant base oil composition that comprises (a) from 80 to 98% by mass of a naphthenic synthetic lubricant base oil having a flash point of not lower than 140° and (b) from 2 to 20% by mass of an alcohol/fatty acid ester having a flash point of not lower than 150° C. of which the alcohol has a gem-type dimethyl structure, for traction-type continuous variable transmissions of automobiles.

11. A method of using a lubricant base oil composition that comprises (a) from 80 to 98% by mass of a naphthenic synthetic lubricant base oil having a flash point of not lower that 140° C. and (b) from 2 to 20% by mass of an alcohol/fatty acid ester having a flash point of not lower than 150° C. of which the alcohol has a gem-type dimethyl structure, for traction drive fluid.

* * * * *